US005918689A

United States Patent [19]

Roberts

[11] Patent Number: 5,918,689

[45] Date of Patent: Jul. 6, 1999

[54] JAR ENHANCER

[75] Inventor: Bill J. Roberts, Houston, Tex.

[73] Assignee: Houston Engineers, Inc., Houston, Tex.

[21] Appl. No.: 08/852,187

[22] Filed: May 6, 1997

[51] Int. Cl.[6] ..... E21B 4/14; E21B 23/04; E21B 31/113

[52] U.S. Cl. ..... 175/297; 166/178

[58] Field of Search ..... 175/296, 297; 166/178

[56] References Cited

U.S. PATENT DOCUMENTS

| | | |
|---|---|---|
| Re. 23,354 | 4/1951 | Storm . |
| 2,659,576 | 11/1953 | Linney . |
| 3,735,827 | 5/1973 | Berryman . |
| 3,797,591 | 3/1974 | Berryman . |
| 3,834,472 | 9/1974 | Perkins . |
| 4,109,736 | 8/1978 | Webb et al. . |
| 4,200,158 | 4/1980 | Perkins . |
| 4,226,289 | 10/1980 | Webb et al. . |
| 4,361,195 | 11/1982 | Evans . |
| 4,456,081 | 6/1984 | Newman . |
| 4,545,444 | 10/1985 | Webb et al. . |
| 4,844,183 | 7/1989 | Evans . |
| 4,846,273 | 7/1989 | Anderson et al. . |
| 5,007,479 | 4/1991 | Pleasants et al. . |
| 5,033,557 | 7/1991 | Askew . |
| 5,086,853 | 2/1992 | Evans . |
| 5,174,393 | 12/1992 | Roberts et al. . |
| 5,232,060 | 8/1993 | Evans . |
| 5,318,139 | 6/1994 | Evans . |
| 5,425,430 | 6/1995 | Roberts . |
| 5,431,221 | 7/1995 | Roberts et al. . |
| 5,447,196 | 9/1995 | Roberts . |
| 5,595,244 | 1/1997 | Roberts . |
| 5,595,253 | 1/1997 | Martin et al. . |

FOREIGN PATENT DOCUMENTS

| | | |
|---|---|---|
| 1597401 | 9/1981 | United Kingdom . |

*Primary Examiner*—David J. Bagnell
*Assistant Examiner*—Chi H. Kang
*Attorney, Agent, or Firm*—Butler & Binion L.L.P.

[57] ABSTRACT

A tool for enhancing the impact of either an upward or downward blow delivered by a single-acting jar to an object stuck in a well bore includes first and second tubular members telescopically arranged and vertically reciprocable with respect to one another to form an annular space between them, upper, lower and intermediate seal rings between equal diameter portions of the tubular members, and a ring carried by the second tubular member within the annular space between the intermediate seal ring and each of the upper and lower seal rings to form upper and lower pressure and charging chambers on the opposite side of each ring, the rings being of such construction that, with each charging chamber filled with a compressible fluid, movement of the second tubular member in one vertical direction will compress the fluid in the upper and lower pressure chambers and thus enhance the impact of a jar in the same vertical direction, and permit flow therepast, in response to movement of the second tubular member in the opposite vertical direction with respect to the first tubular chamber, whereby charging fluid may be added to each of the upper and lower pressure chambers, respectively.

4 Claims, 5 Drawing Sheets

JAR ENHANCER

This invention relates generally to a tool for enhancing the impact of ajar delivered to an object stuck in a well bore. In one of its aspects, it relates to improvements in a tool of this type for enhancing the impact of one of either an upward or a downward blow delivered to the object by a "single acting" jar, and, more particularly, to such a jar enhancer having a unique system by which upper and lower chambers thereof may be charged with compressible fluid in which energy is stored for use in enhancing the impact of the jar.

As well known in the art, a conventional hydraulic jar comprises a pair of telescopically arranged, tubular members, one for connection to the stuck object and the other to a pipe string for raising and lowering therewith within the well bore. More particularly, the members are circumferentially spaced apart to form an annular space between them, with one member having a cylindrical surface which forms a restriction within the space and the other carrying detent means which fits closely within the restriction so as to retard its movement therethrough and thus stretch the pipe string as it is raised, in the case of an up jar, or retard its movement therethrough and thus compress the pipe string as it is lowered, in the case of a down jar. Upon movement of the pipe string in the opposite direction, following a jar, the detent means permits relatively free movement of the hydraulic fluid therepast so that the tool may be returned to a position for imparting another jar in the desired direction. The tubular members also have oppositely facing shoulders which are adapted to engage as the detent means moves out of the restriction so that the energy stored in the drill string imparts a jar to the object in the desired direction.

As recognized in pending U.S. Pat. No. 5,595,244, and assigned to the assignee of the present application, there was a need in the industry, particularly as wells were drilled to greater depths, to be able to apply greater loads to the jar without exceeding its burst strength. This would enable the operator of the tool to obtain a better balance between burst of the outer housing and collapse of the inner mandrel, which, of course, is crucial. Thus, if a jar is over-pulled, it is better for the cylinder to burst than for the mandrel to collapse, because, in the latter case, it would be impossible to enter the inner diameter of the pipe string with free point indicators, string shots, etc.

For this purpose, the single acting hydraulic jar of this prior application has means sealing between upper, lower and intermediate equal diameter portions of its tubular members, an upper piston ring sealably slidable within the annular space between the members intermediate the upper and intermediate sealing means to form an upper pressure chamber in the space on one end of said upper piston ring, and a lower piston ring sealably slidable with the annular space between the members intermediate the lower and intermediate sealing means to form a lower pressure chamber in the space on one end of said lower piston ring. These chambers are adapted to be filled with hydraulic fluid, and the outer tubular member has ports connecting the exterior thereof with the annular space on the other ends of the piston rings, whereby the pressure of the hydraulic fluid in the chambers is equal to that outside of the jar.

More particularly, the first tubular member has an upper cylindrical restriction in the upper chamber and a lower cylindrical restriction in the lower chamber, and upper detent means are carried by the second tubular member within the upper chamber for movement through the upper restriction so as to restrict the flow of hydraulic fluid within said chamber, as the second tubular member is raised with the pipe string with respect to the first tubular member, and permit relatively free flow of such fluid within the chamber as the second tubular member is lowered with the pipe string with respect to the first tubular member. The lower detent means, on the other hand, are carried by the second tubular member within the lower chamber so as to restrict the flow of hydraulic fluid within the chamber simultaneously with the restriction of flow in said upper chamber as the second tubular member is raised with the pipe string with respect to the first tubular member and permit relatively free flow of such fluid within the lower chamber simultaneously with the relatively free flow in said upper chamber as the second tubular member is lowered with the pipe string with respect to said first tubular member.

The tubular members have shoulders thereon for engaging one another to impart an up jar to the stuck object, when the detents are moved out of the restrictions. Due to the upper and lower chambers, the fluid pressure in each of the tipper and lower chambers may be essentially only 50% of what it would otherwise be, so that the load on the jar may be doubled without increasing the risk of damage.

It is also well known in the art to enhance the impact of such jars by means of a jar enhancer connected intermediate the jar and the well pipe string, and comprising a second tubular member or inner mandrel having an upper end adapted to be connected to the well pipe string above it, and a first tubular member or outer housing arranged telescopically of the mandrel member to form an annular space between them and having a lower end adapted to be connected to the mandrel member of the jar (or to drill collars above the jar). More particularly, the space may be a chamber which is charged with a compressible fluid which may be a gas, such as nitrogen, or a compressible liquid, such as silicone, and a piston on the mandrel may sealably slide with respect to the space to compress the fluid in the space above it as the mandrel is raised, in the case of an upward jar, or below it as the second member is lowered, in the case of a downward jar.

U.S. Pat. No. 5,447,196 discloses a double acting jar—i.e., one in which both up and down jars may be imparted to the object—which also has upper and lower pressure chambers which are so arranged that the pressure in each may be essentially 50% of what it would otherwise be. U.S. Pat. No. 5,425,430, on the other hand, discloses a jar enhancer for use with such a double acting jar, and which, as in the U.S. Pat. No. 5,595,244 recognizes the need to be able to apply greater loads to the jar enhancer without exceeding its burst strength. Hence, as explained in such patent, the jar enhancer includes upper and lower chambers so arranged in which fluid therein is compressed during up as well as down jars.

In the double acting jar enhancer of U.S. Pat. No. 5,425,430, compressible fluid from a suitable source may be introduced through a check valve into the outer tubular member into a charging chamber within the space between the means formed between the upper seal ring of a first set and the lower seal ring of a second set of such rings sealably slidable within the space to form upper and lower pressure chambers. The upper of the first set of seal rings has valve means to permit flow from the charged chamber only into the upper chamber, and the lower of the second set of seal rings has valve means to permit flow of the fluid from the charged chamber only into the lower chamber.

An object of this invention is to provide a jar enhancer which has the advantages of the above described double-acting jar enhancer, but is particularly well suited for use with a one way jar, such as the type disclosed in U.S. Pat. No. 5,595,244.

This and other objects are accomplished, in accordance with the illustrated embodiment of the present invention, by means of a single acting jar enhancer of the type described, which includes a first tubular member having a lower end adapted to be connected to the tubular part of a jar on which the hammer or anvil is formed, and a second tubular member vertically reciprocable and telescopically arranged with respect to the first tubular member to form an annular space between them and having an tipper end adapted to be connected to a well pipe string above it for raising and lowering therewith. Means are provided for sealing between upper, lower and intermediate equal diameter portions of the tubular members, and means are carried on the second tubular member within the annular space between the upper and intermediate sealing means to form an upper pressure chamber on one side thereof and an upper charging chamber on the other side thereof, and on the second tubular member within the annular space between the intermediate and lower sealing means to form a lower pressure chamber on one side thereof and a lower charging chamber on the other side thereof.

Inasmuch as there are a pair of charging chambers, as compared to the single charging chamber of the double acting jar enhancer of U.S. Pat. No. 5,425,430, it is not possible to charge each through a single port in the outer member. However, in accordance with one novel aspect of the present invention, there are a pair of ports in the outer members, each to connect with one of the charging chambers so as to receive a compressible charging fluid, and each of said upper and lower means chamber forming means includes valve means which prevents flow therepast, in response to movement of the second tubular member in one vertical direction with respect to the first tubular member, so that, with the charging chambers filled with a compressible fluid, movement of the second tubular member in said one direction will compress the fluid in the upper and lower pressure chambers and thus enhance the impact of a jar in the same vertical direction, but which permits flow therepast in response to movement of the second tubular member in the opposite vertical direction with respect to the first tubular chamber, whereby charging fluid may be added to each of the upper and lower pressure chambers, respectively.

Thus, with the tool in "closed" position—i.e., with the inner and outer tubular members fully contracted—both charging chambers may be filled simultaneously with compressible fluid from the same source, to insure that the pressure in each will be the same as the tool is expanded to its "open" position. Additional ports in the outer member connect with each of the pressure chambers to receive gauges by which an imbalance in the chambers may be detected, and balance restored by either charging the chamber in which the pressure is lower, or bleeding the chamber in which it is higher through an additional bleed port.

As illustrated, and in the preferred embodiment of the invention, each valve means comprises a ring carried by the second member for vertically shifting between first and second positions, with one side sealably sliding with respect to the first member and the other side forming a flow passage between the ring and second member. More particularly, each ring has an end adapted to seat on a shoulder of the second tubular member to close the passage, in its first position, and an opposite end to engage an oppositely facing shoulder of the second member to permit flow through the passage in its second position.

In the drawings, wherein like reference characters are used throughout, FIGS. 1A, 1B, 1C and 1D are longitudinal sectional views of the uppermost, upper intermediate, lower intermediate, and lowermost portions of a jar enhancer constructed in accordance with the present invention, and shown in "closed" position.

Figure 1A:
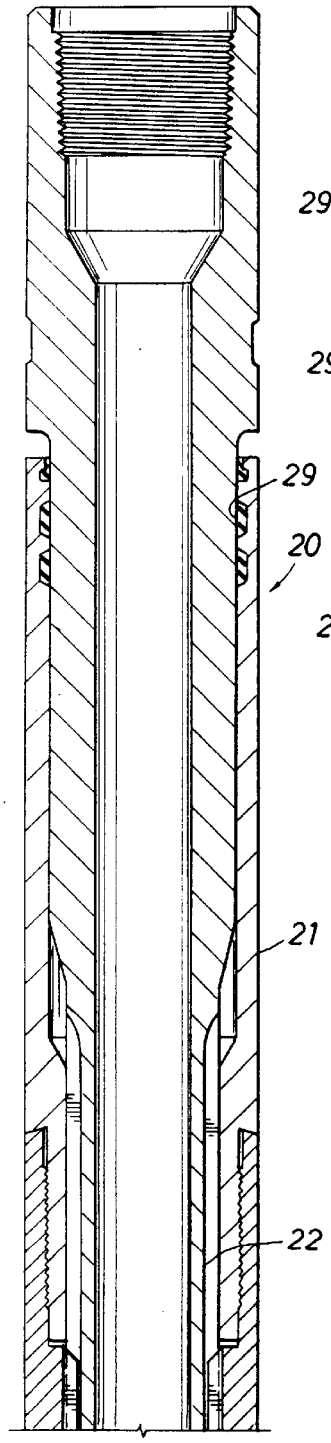
Figure 1B:
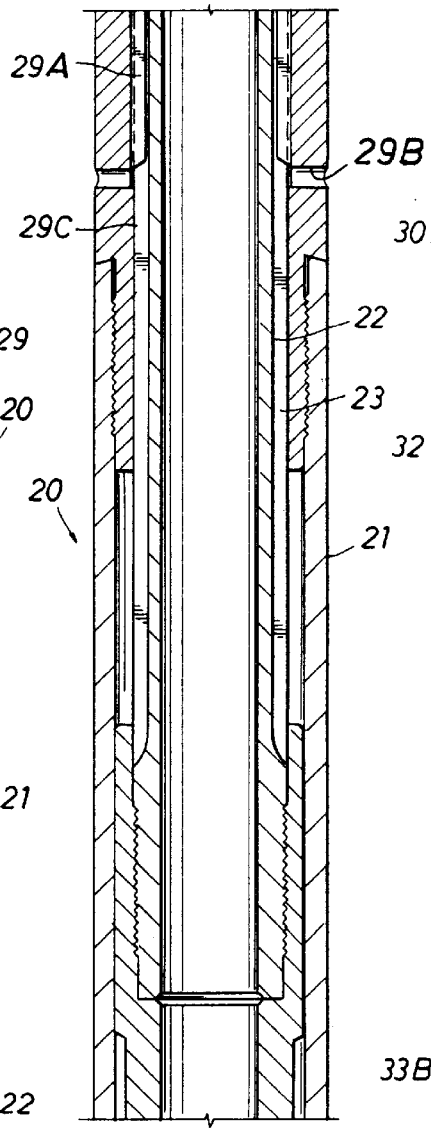

With reference now to the details of the above-described drawings, the overall jar enhancer, which is indicated in its entirety by reference character 20, is shown to comprise a first tubular member or housing 21 having a lower pin end adapted to be connected to the tubular part of a jar (not shown) which has a hammer arranged to deliver a blow to an anvil on another tubular part of the jar connected to the object stuck in the well bore, and a second tubular member or mandrel 22 which is vertically reciprocable and telescopically arranged within the housing of the first tubular member to form an annular space 23 between them and which has an upper box end (FIG. 1A) for connection to a well pipe above it for raising and lowering therewith. As shown in FIGS. 1A–1D, the tool is in its "closed" position wherein the members are fully contracted with respect to one another so that further contraction is limited by opposing shoulders on the upper ends of both, as shown in FIG. 1A.

Upper, intermediate and lower packings 24, 25, 26 are carried on the inner diameter of the outer tubular member or housing for sealably engaging equal diameter portions of the inner tubular member or mandrel. Means including a ring 27 is carried about the inner tubular member intermediate the upper and intermediate packing 24, 25 to divide the space between the upper and intermediate packings into an upper pressure chamber UPC and an upper charging chamber UCC, and means including a ring 28 is carried by the inner tubular member between the intermediate and lower packings 25, 26 to divide the space between the intermediate and lower packing means into a lower pressure chamber LPC and a lower charging chamber LCC.

Packing 29 is also carried by the uppermost end of the outer tubular member for slidably engaging the inner tubular member, and ports 29B are formed in the outer tubular member to connect the space above the upper packing 24 with the well bore about the tool. As is common in the art, splines 29A are formed within this space on the inner diameter of the outer member for engaging within slots 29C in the outer diameter of the inner tubular member to prevent rotation between them as the tool is elongated and contracted in response to relative vertical movement between the tubular members.

As previously described, each of the upper and lower pressure chambers UPC and LPC is adapted to be filled with fluid, such as nitrogen, which, as will be described, is adapted to be compressed as the inner tubular member is raised with the drill string during an up jarring event. More particularly, the upper pressure chamber UPC is charged with compressible fluid from the upper charging chamber UCC, while the fluid in the lower pressure chamber LPC is adapted to be charged with compressible fluid from the lower charging chamber LCC. The upper charging chamber UCC is adapted to be filled with a charging fluid through an upper port UP, while the lower charging chamber LCC is adapted to be filled with charging fluid through a lower port LP.

Figure 2A:
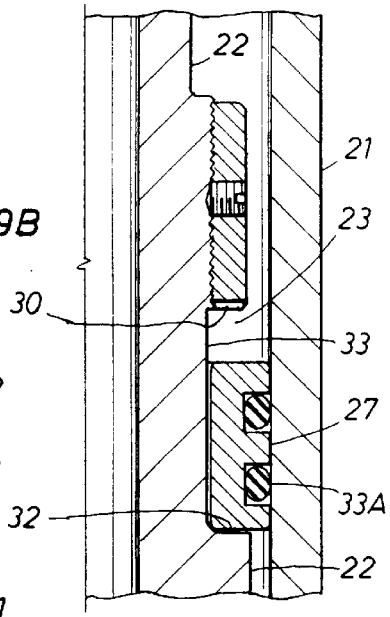
FIG. 2A is an enlarged cross-sectional view of one of the valve means when the tool is in the closed position, as shown in FIGS. 1A to ID.
Figure 2B:
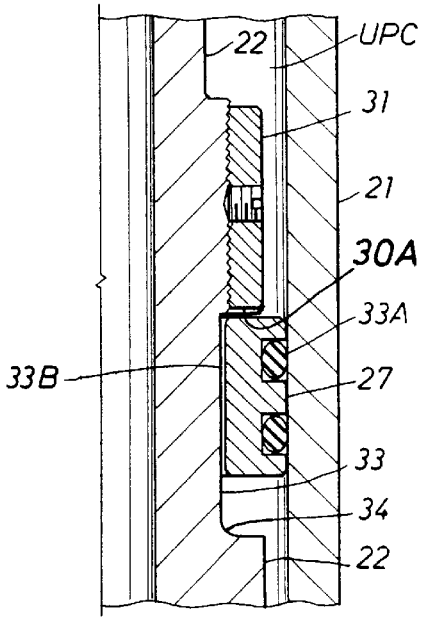
FIG. 2B is a view similar to FIG. 2A but with the valve means shown in the position it occupies during charging thereof, as in FIGS. 4A and 4B.
Figure 1C:
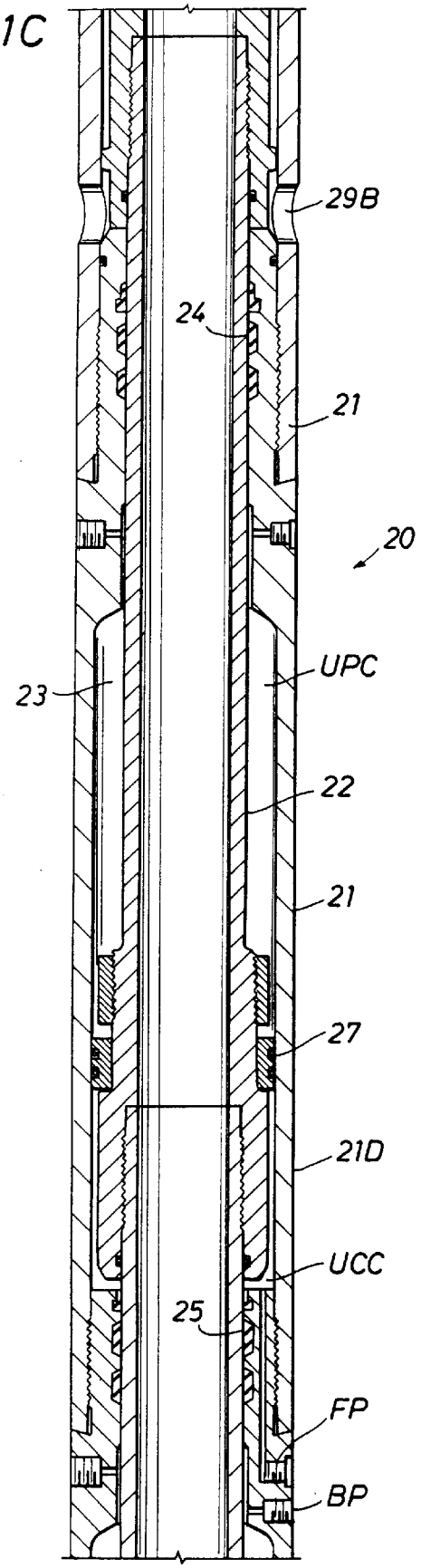
Figure 1D:
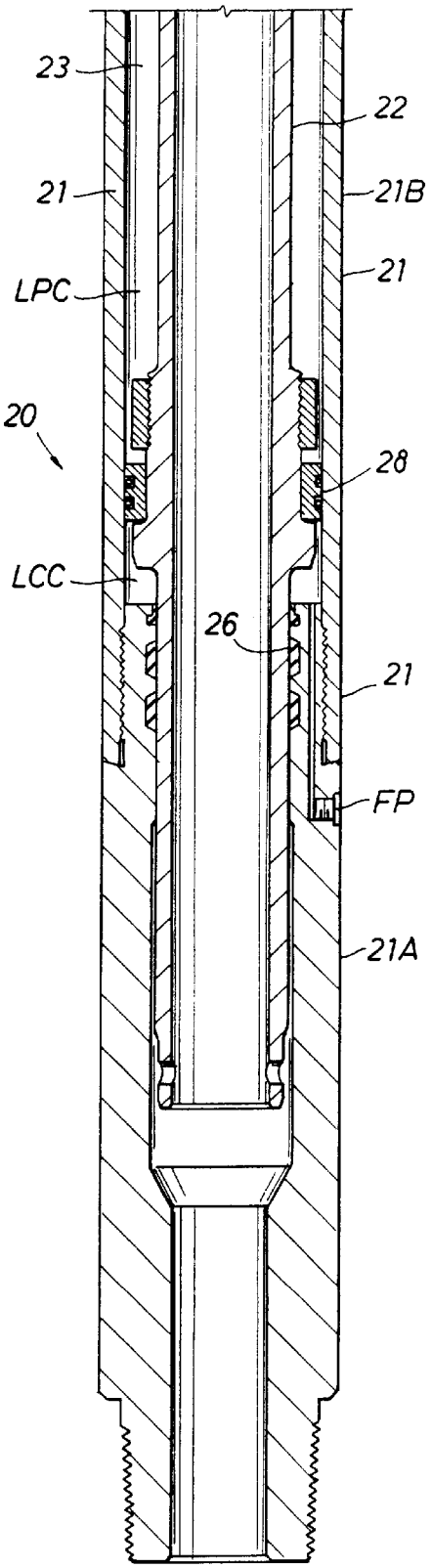

Each of the rings 27, 28 is received in a recess 33 (see FIGS. 2A and 2B) between oppositely facing shoulders on the tubular member to permit relative reciprocation between the ring and the inner tubular member, and has O-rings 33A thereabout for sealably sliding along the inner diameter of the outer tubular member. Thus, as shown, each ring is received between a shoulder 30 on the lower end of a collar 31 threaded to the inner tubular member above the ring, and a shoulder 32 on the upper end of an enlarged portion of the tubular member 22. More particularly, as shown in FIGS. 2A and 2B, the inner diameter of each ring closely surrounds the outer diameter of the recess 33 but has vertical slots 33B between the shoulders which provide a passage between them. The intersection of the lower end of the recess and the upwardly facing shoulder 32 is formed on a radius to provide a seat 34 in position to be engaged by the lower inner corner of the ring, when the ring is in its lowermost position, to prevent flow between the pressure and charging chambers. On the other hand, as best shown if FIG. 2B, radial slots 30A are formed in downwardly facing shoulder 30 so that when the ring is in its upper position, or in any intermediate position above the seat 34, it opens the passage to flow therethrough.

Figure 3A:
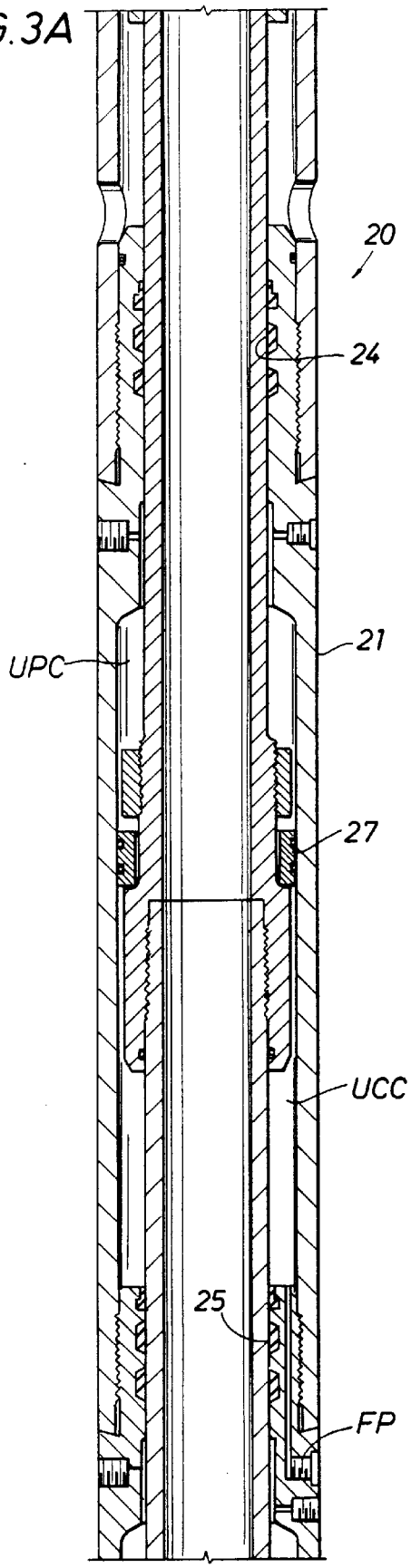
FIGS. 3A and 3B are additional longitudinal sectional views of the lower intermediate and lowermost portions of the jar enhancer similar to FIGS. 1B and 1C, but with the inner member thereof shown raised from its closed position during the imposition of an upward jar imparted to the drill string.
Figure 3B:
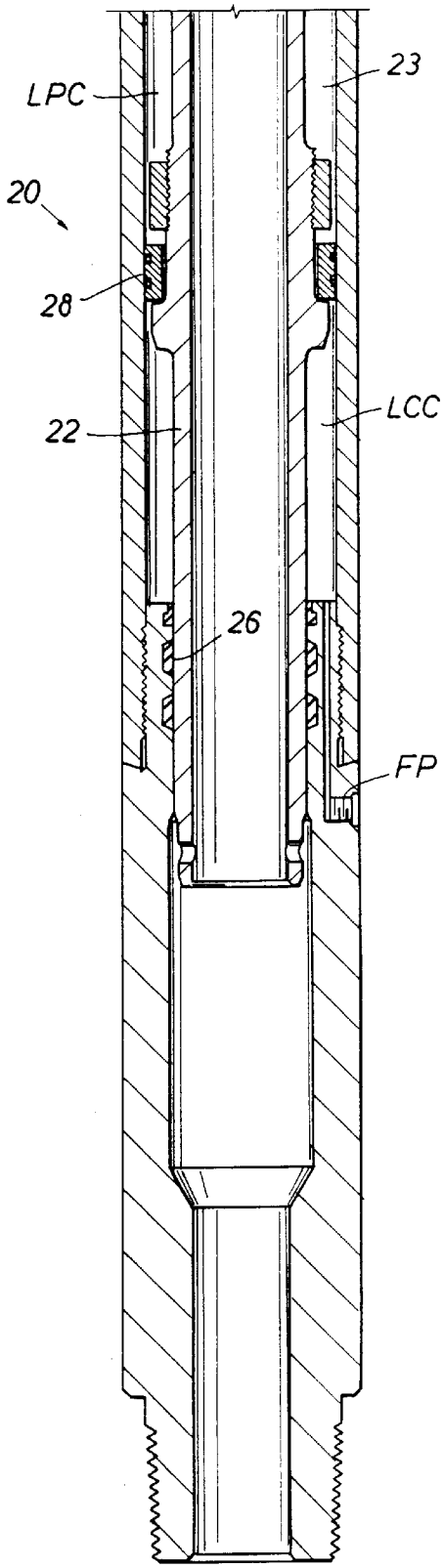

Thus, as each of the upper and lower charging chambers UCC, LCC is filled with a charging fluid through the ports leading thereto, the rings 27, 28 will be raised off their seats to permit the charging fluid to flow therepast into the pressure chamber thereabove, until the pressures are equalized in the respective pairs of charging chambers. An upward pull on the inner tubular member, during a jarring event will, upon raising the rings into engagement with the shoulder, and further compress fluid in the pressure chambers above it, as the tubular member continues to be raised until the jar event has occurred. After the jarring event, and slacking off of the inner tubular member, the inner member will be urged back by the pressure in the pressure chambers from the position of FIG. 3A toward the essentially closed position of FIGS. 1A to 1D, at least until pressure in the charging and pressure chambers equalize.

Figure 4A:
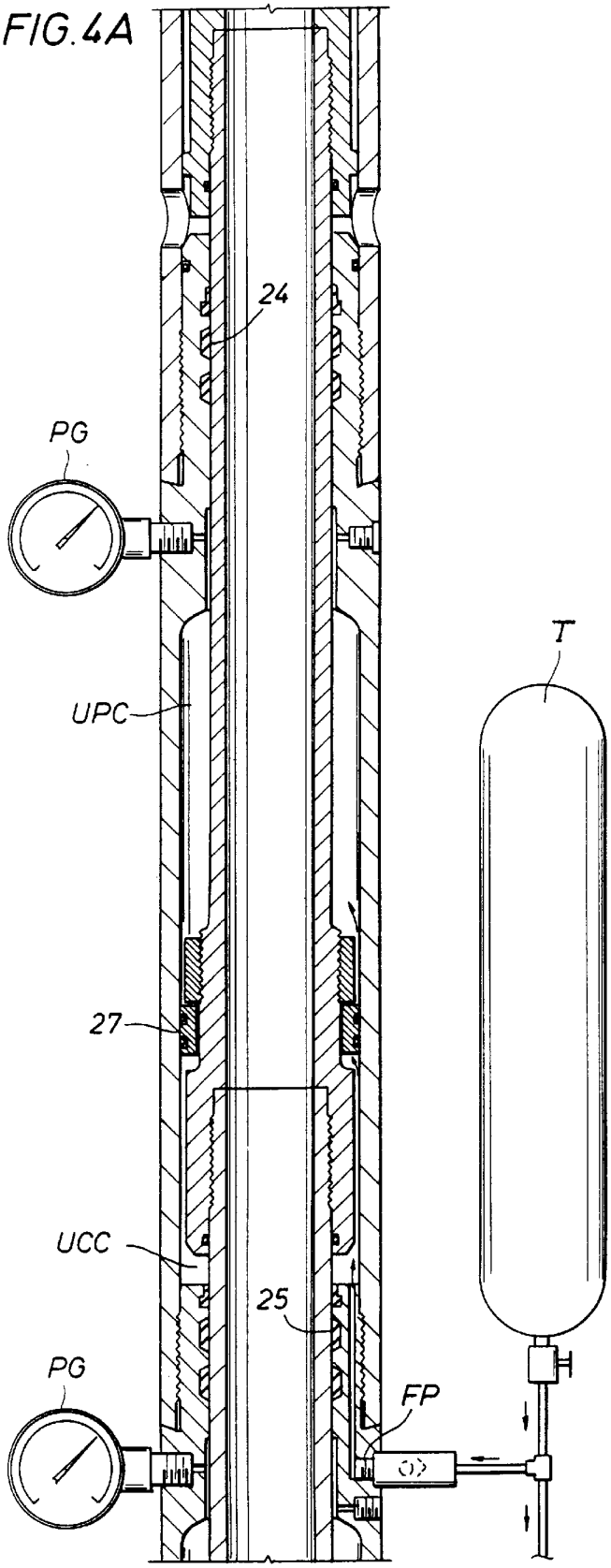
FIGS. 4A and 4B are further longitudinal sectional views of the jar enhancer similar to FIGS. 3A and 3B, in its closed position, but removed from a well bore and during charging chambers from a single container of compressed fluid.
Figure 4B:
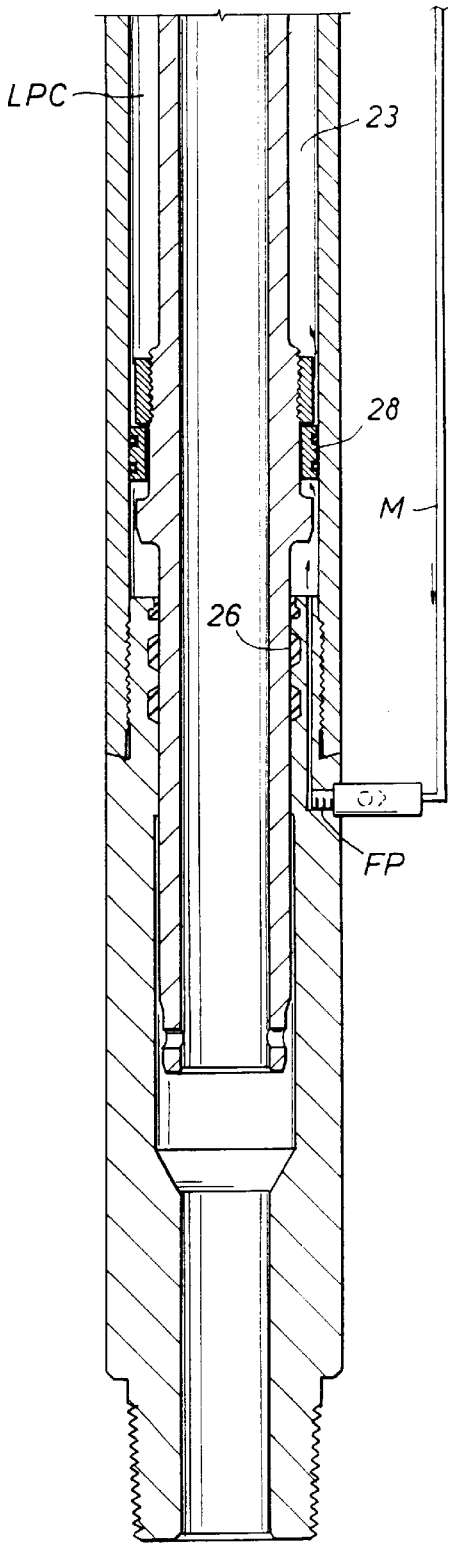

As shown if FIGS. 4A and 4B, upon removal from the well bore, and while occupying its closed position, the charging chambers of the tool may be charged with fluid from the tank T having a control valve CV intermediate the outlet of the tank and a manifold M having branch lines leading to a check valve installed in each fill port FP in the outer member connecting with the lower end of each of upper charging chamber UCC and lower charging chamber LCC. This of course raises each of the rings 27, 28 to permit flow simultaneously therepast into each of the charging chambers with compressible fluid at the same pressure.

During the charging procedure, the pressure in the pressure chambers may be increased to multiples of that within the tank, and, for this purpose, the control valve may be closed and the inner tubular member hung off to cause the pressure in the pressure chambers to be increased due to the weight of the outer tubular member and the vacuum created in the charging, chambers. The control valve in the manifold may then be opened again to admit additional charging fluid from the tank into the charging chambers and thus past rings 27, 28 into the pressure chambers, thereby raising the tubular member from the hung off position of FIGS. 4A and 4B to the further charged positions of FIGS. 5A and 5B. The creation of this vacuum in the charging chamber actually adds to the accumulation of energy in the charging chamber, which when the jar and its hammer are released for free travel into engagement with the anvil, will further enhance the impact of the jar.

Figure 5A:
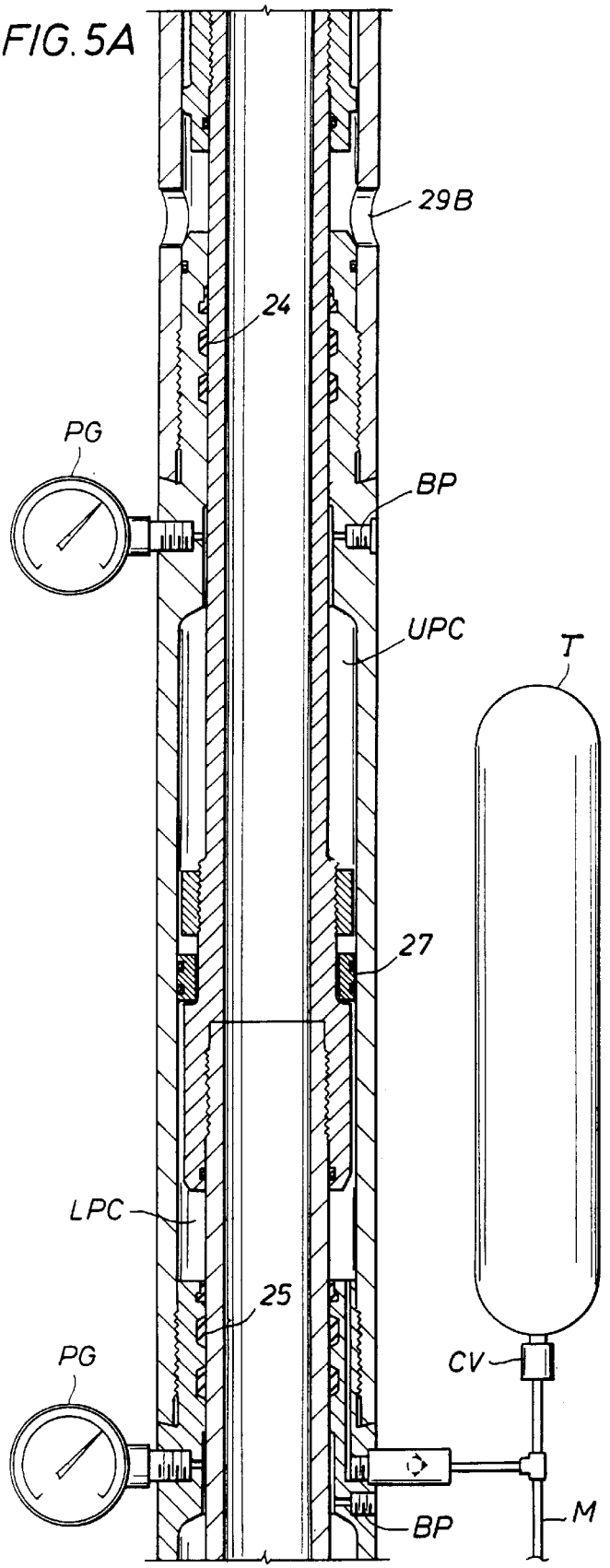
FIGS. 5A and 5B are still further longitudinal sectional views of the jar enhancer similar to those of FIGS. 4A and 4B, but upon hanging off of the tool to compress the fluid in the charging chamber prior to the introduction of additional charging fluid.
Figure 5B:
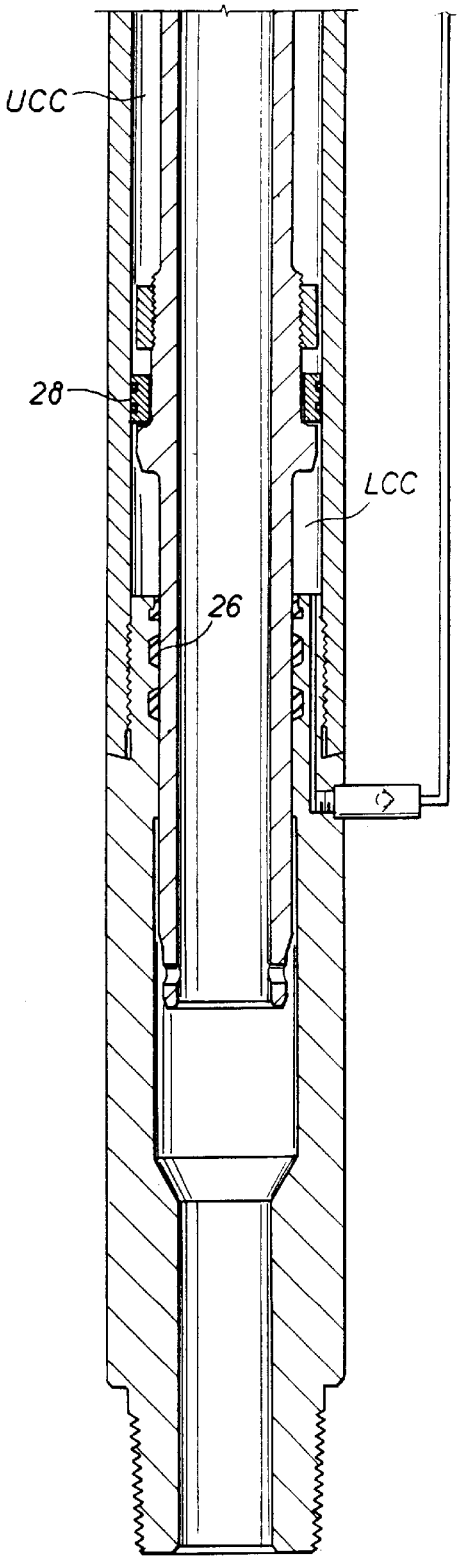

As shown in FIGS. 4A and 5A, pressure gauges PG are connected to additional ports connecting with each of the pressure chambers, such that the operator is able to detect an imbalance in pressure in the chambers. In this case, the operator may bleed the pressure from the chamber in which the larger pressure resides by opening a bleed port BP connected therewith. Alternatively, one of the branches of the manifold may be closed to permit charging of only the pressure chamber in which the lower pressure resides.

The inner end of each of the fill ports connects with a vertical passageway formed in an enlarged inner diameter portion of a lower tubular section of the outer tubular member opposite threads which connect to the lower end of the tubular section of the outer tubular member thereabove. That tubular section in turn has an enlarged upper end through which the upper passageway is formed laterally opposite threads connecting its upper end with the lower end of the next upper section of the outer tubular member. The upper end of the latter tubular section is in turn inwardly enlarged to receive the ports for the upper pressure gauge and upper bleed port beneath the upper threaded section thereof threadedly connected to the lower end of the threaded portion of the tubular member above it, and just below the lowermost ports in the outer tubular member leading to the spleen chamber. This construction of course permits the ports to be drilled in thicker portions of the outer tubular member, while at the same time reducing the vertical extent of the tool to a minimum.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A tool for enhancing the impact delivered to an object stuck in a well bore by means of a jar having a first tubular part connected to the object and a second tubular part having a hammer arranged to deliver a blow to an anvil on the first tubular part in response to vertical movement with respect to the first tubular part, said tool comprising;

a first tubular member having a lower end adapted to be connected to said second tubular part of the jar, a second tubular member vertically reciprocable and telescopically arranged with respect to the first tubular member to form an annular space between them and having an upper end adapted to be connected to a well pipe string above it for raising and lowering therewith, upper, lower and intermediate sealing means between equal diameter portions of the tubular members, means carried by the second tubular member within the annular space between the upper and intermediate sealing means and sealably slidable within the cylindrical surface of the first tubular member to form an upper pressure chamber on one side thereof and an upper charging chamber on the other side thereof, means carried by the second tubular member within the annular space between the intermediate and lower sealing means and sealably slidable within the cylindrical surface of the first tubular member to form a lower pressure chamber on one side thereof and a lower charging chamber on the other side thereof, and means in the outer of the members through which a compressible charging fluid may be added to each of the upper and lower charging chambers, each of said upper and lower chamber forming means preventing flow therepast, in response to movement of the second tubular member in one vertical direction with respect to the first tubular member, so that, with the pressure chambers filled with a compressible fluid, movement of the second tubular member in said one direction will compress the fluid in the upper and lower pressure chambers and thus enhance the impact of a jar in the same vertical direction, and permitting flow therepast, in response to movement of the second tubular member in the opposite vertical direction with respect to the first tubular chamber, whereby charging fluid may be added to each of the upper and lower pressure chambers, respectively.

2. A tool as in claim 1, wherein:

each chamber forming means comprises a ring which is vertically shiftable with respect to the second member between first and second limited positions and which has one side sealably slidable with respect to the first tubular member, the other side of the ring and the second member forming an annular flow passage between them, and one end of the ring being adapted to seat on a shoulder of the second tubular member to close the passage.

3. A tool as in claim 1, wherein: means in the outer member to which a pressure gauge may be connected to each charging chamber.

4. A tool as in claim 1, wherein: the first member is disposed about the second member.

* * * * *